United States Patent [19]

Sano et al.

[11] Patent Number: 4,864,187

[45] **Date of Patent: * Sep. 5, 1989**

[54] CATHODE FOR ELECTRON TUBE AND MANUFACTURING METHOD THEREOF

[75] Inventors: Kinjiro Sano; Toyokazu Kamata, both of Nagaokakyo; Keiji Fukuyama, Kamakura; Masato Saito, Kamakura; Keiji Watanabe, Kamakura, all of Japan

[73] Assignee: Mitsubishi Denki Kabushiki Kaisha, Tokyo, Japan

[ * ] Notice: The portion of the term of this patent subsequent to Jan. 10, 2006 has been disclaimed.

[21] Appl. No.: 864,566

[22] Filed: May 16, 1986

[30] Foreign Application Priority Data

May 25, 1985 [JP] Japan ..... 60-112601
May 25, 1985 [JP] Japan ..... 60-112602

[51] Int. Cl.[4] ..... H01J 1/20

[52] U.S. Cl. ..... 313/346 R; 313/355; 252/521

[58] Field of Search ..... 313/346 R, 345, 337, 313/355, 346 DC; 252/521

[56] References Cited

U.S. PATENT DOCUMENTS

| | | | |
|---|---|---|---|
| 1,794,298 | 2/1931 | Just | 313/346 |
| 3,358,178 | 12/1967 | Figner et al. | 313/346 |
| 3,922,428 | 11/1975 | Cronin | 313/346 |
| 4,310,777 | 1/1982 | Fukushima et al. | 313/346 R |
| 4,350,920 | 9/1982 | Bertens | 313/346 R |
| 4,369,392 | 1/1983 | Hotta et al. | 313/346 R |
| 4,518,890 | 5/1985 | Taguchi et al. | 313/346 R |
| 4,594,220 | 6/1986 | Hasker et al. | 313/346 R |

FOREIGN PATENT DOCUMENTS

| | | | |
|---|---|---|---|
| 0091161 | 4/1982 | European Pat. Off. . | |
| 477232 | 6/1922 | Fed. Rep. of Germany | 313/346 |
| 880181 | 11/1951 | Fed. Rep. of Germany | 313/346 |
| 976106 | 11/1954 | Fed. Rep. of Germany | 313/346 |
| 53-5011 | 1/1978 | Japan | 313/346 |
| 56-611980 | 2/1980 | Japan | 313/346 X |
| 56-78055 | 6/1981 | Japan | 313/346 |
| 98281980 | 1/1984 | Japan | 313/346 |
| 59-20941 | 2/1984 | Japan | 313/346 |
| 59-138033 | 8/1984 | Japan | 313/346 |
| 59-191226 | 10/1984 | Japan . | |
| 60-1718 | 1/1985 | Japan . | |
| 2116356 | 3/1982 | United Kingdom . | |

OTHER PUBLICATIONS

Haas et al., *Interatomic Auger Analysis of the Oxidation of Thin Barium Films,* Applications of Surface Science 16, North Holland Publishing Co. (1983) pp. 142–143, 148–149 and 156–162.

Yamamoto et al., *Electron Emission Properties and Surface Atom Behavior of Impregnated Cathodes with Rare Earth Oxide Mixed Matrix Base Metals,* Applications of Surface Science 20, Elseview Science Publishers B.V. (1984) pp. 61–83.

R. O. Jenkins, A Review of Thermionic Cathodes, Vacuum, vol. 19, No. 8, Pergamon Press Limited, Great Britain, Sections 4.2 and 4.2.2.

*Primary Examiner*—James J. Groody
*Assistant Examiner*—Mark R. Powell
*Attorney, Agent, or Firm*—Lowe, Price, LeBlanc, Becker & Shur

[57] ABSTRACT

A cathode for an electron tube in accordance with the present invention comprises: a base containing not only nickel as a major element but also a reducing agent; a layer of an electron-emissive substance which is applied to the base and contains not only an alkaline earth metal oxide as a principal component but also a scandium oxide; and a heater for heating the layer.

14 Claims, 4 Drawing Sheets

CATHODE FOR ELECTRON TUBE AND MANUFACTURING METHOD THEREOF

CROSS REFERENCE TO RELATED APPLICATION

This application is related to copending application Ser. No. 886,777, filed on July 17, 1986.

BACKGROUND OF THE INVENTION

1. Field of the Invention

This invention relates to a cathode for an electron tube and more particularly to improvement in electron emission characteristics of the cathode.

2. Description of the Prior Art

It is now still desired to make the electron beam diameter further smaller for improvement of the resolution in a cathode-ray tube for a high resolution display, a projection picture tube for a large screen, or the like. It is also desired to increase the emission current of a cathode in such an electron tube in order to improve brightness of the image particularly in a recent large-scaled tube. Therefore, there is a high demand for a cathode which can be used at a high current density, for example, in a recent high-graded cathode-ray tube or an image pickup tube for the TV system.

Referring to FIG. 1, there is illustrated the structure of a cathode in a sectional view. Engaged with a sleeve 1 is a base 2 to which a layer 3 of an electron-emissive substance is applied. The base 2 is made of Ni containing a small amount of a reducing agent such as Si or Mg. A heater 4 for heating the electron-emissive layer 3 is provided inside the sleeve 1.

A conventional electron-emissive layer 3 is made from a powder of a composite alkaline earth metal carbonate which contains elements of Ba, Sr and Ca. A suspension which contains the powder and a binder is applied to the base 2 by a spray method or the like. The applied suspension is heated in a dynamic vacuum and then aged at a higher temperature.

In order to prepare the suspension which has a viscosity suitable for, e.g., a spray application and has a uniform adhesiveness to the base 2, the powder is usually mixed with the binder and a solvent in a ball mill for about 24 hours. Typically, an organic solvent such as butyl acetate or alcohol is used as the solvent, and nitrocellulose dissolved in an organic solvent such as butyl acetate may be used as the binder.

The alkaline earth metal carbonate layer applied to the base 2 is heated by the heater 4 in a dynamic vacuum thereby to convert it into a ternary composite oxide layer of (Ba, Sr, Ca)O. This conversion can be expressed by the following reaction formula (1), and the generated $CO_2$ gas is evacuated by a vacuum pump.

$$(Ba, Sr, Ca)CO_3 \rightarrow (Ba, Sr, Ca)O + CO_2 \quad (1)$$

After the conversion, the composite oxide layer on the base 2 is aged at a higher temperature of 900°–1100° C. so that the ternary composite oxide of (Ba, Sr, Ca)O may be reduced to produce at least some of free Ba by a reducing element such as Si or Mg contained in the base 2 thereby to form the electron-emissive layer 3. Such a reducing element in the base 2 diffuses toward the interface between the composite oxide layer and the base 2, and then reacts with the composite oxide. For example, the reduction of BaO is expressed by the following formula (2*a*) or (2*b*).

$$2BaO + Si = 2Ba + SiO_2 \quad (2a)$$

$$BaO + Mg = Ba + MgO \quad (2b)$$

When part of BaO in the composite oxide layer is reduced to free Ba, the layer becomes a semiconductor of an oxygen deficient type. Consequently, the layer 3 of the electron-emissive substance is obtained and it can be used at a current density of 0.5–0.8 A/cm$^2$ at an operating temperature of 700°–800° C.

With the conventional cathode, an emission current density higher than that above described can not be obtained for the following reasons ① and ②. ① As a result of the reaction during the aging, an intermediate layer of an oxide such as $SiO_2$ or MgO is formed between the base 2 and the electron-emissive layer 3, so that the current is limited by a high resistance of the intermediate layer. ② The reduction of the alkaline earth metal oxide is limited by the intermediate layer and thus a sufficient amount of free Ba is not produced.

As described above, the conventional cathode can not be used at a high current density. Further, there exists a problem that since the conventional electron-emissive layer 3 is of a semiconductor, the layer 3 may be destroyed thermally due to the Joule heat at a high current density.

SUMMARY OF THE INVENTION

It is an object of this invention to provide a cathode for an electron tube having improved electron emission characteristics.

It is another object of this invention to provide a long-lived cathode for an electron tube.

It is a further object of this invention to provide a cathode for an electron tube having stable electron emission characteristics.

It is a still further object of this invention to provide a method for manufacturing the above improved cathode.

A cathode for an electron tube in accordance with the present invention comprises: a base containing not only nickel as a major element but also a reducing agent; a layer of an electron-emissive substance which is applied to the base and which contains not only an alkaline earth metal oxide as a principal component but also a scandium oxide; and a heater for heating the layer.

A method for manufacturing a cathode for an electron tube in accordance with the present invention comprises the steps of: subjecting a scandium oxide powder to a heat treatment; preparing a suspension which contains the heat-treated scandium oxide powder and an alkaline earth metal carbonate powder; and applying said suspension to a base in order to form an electron-emissive layer.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Embodiments in accordance with this invention will be described below.

A scandium oxide powder was first subjected to a heat treatment at 1000° C. for 1 hr in the air. In the meantime, a suspension which contains an alkaline earth metal carbonate has been prepared in advance. Then, the scandium oxide powder was mixed and well dispersed in the suspension by a ball mill. Finally, suspensions which contain the scandium oxide powder in the ratio of 0.1, 1.0, 5.0, 10 and 20 wt. % with respect to the alkaline earth metal carbonate powder were prepared. Those suspensions were applied to the respective bases 2. When the bases are 2 mm in diameter, it is preferable that layers of the respective applied suspensions are formed to be 60–100 μm in thickness. Cathodes thus prepared were then incorporated into respective electron guns (not shown). Those cathodes were heated under a dynamic vacuum and aged by a conventional method thereby to complete respective cathode-ray tubes.

Figure 1:
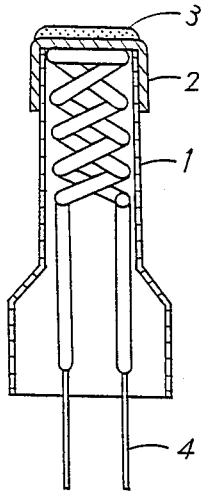
FIG. 1 illustrates the structure of a cathode for an electron tube in a sectional view.
Figure 2:
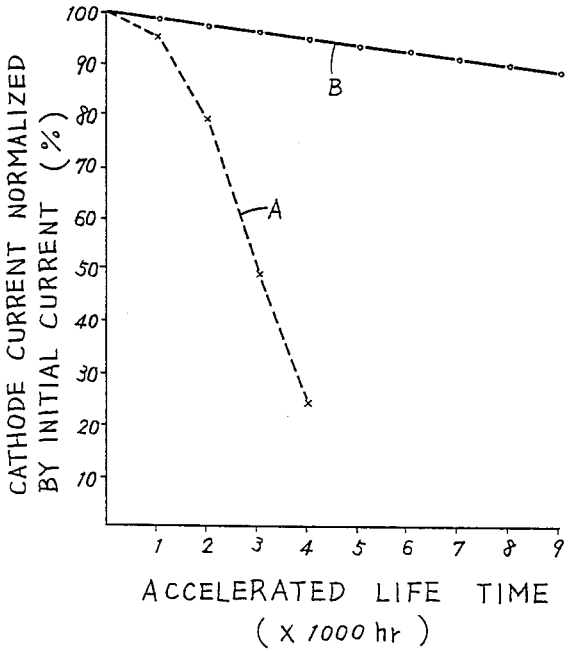
FIG. 2 shows results of accelerated life tests of a conventional cathode and a cathode according to the present invention.

Referring to FIG. 2, there are shown results of accelerated life tests of a conventional cathode and one of the present cathodes with an initial current density of 2 $A/cm^2$. The current density of 2 $A/cm^2$ is three times larger than the usual density. The vertical axis indicates the cathode current normalized by the initial one, while the horizontal axis indicates the life test period. A broken line A represents the conventional cathode, while a solid line B represents a cathode which has an electron-emissive layer containing the scandium oxide in 5.0 wt. %. It is clearly understood from the lines A and B that the present cathode has a much longer life period and is much more stable in comparison with the conventional cathode. Namely, it is found that the present cathode can be used substantially maintaining the high current density of 2 $A/cm^2$ at the operation temperature of 700°–800° C.

It is believed that the good electron emission characteristics of the present cathode is caused by the following reasons (1) and (2).

(1) The scandium oxide reacts with the alkaline earth metal oxide, e.g., BaO and forms a composite oxide of $Ba_3Sc_4O_9$. This composite oxide dispersed in the electron-emissive layer 3 tends to thermally decompose and produce free Ba at the operation temperature of the cathode. Although the formation of free Ba in the conventional cathode completely depends on the reducing process caused by the element Si or Mg in the base 2, the thermal decomposition of the composite oxide produces additional free Ba in the present cathode. Therefore, there exists enough free Ba in the present cathode, even though the reducing process is limited by the intermediate layer described before.

(2) Some of the composite oxide also sets the Sc element free and produces metallic Sc dispersed in the electron-emissive layer 3. This metallic Sc increases electric conductivity of the electron-emissive layer 3, compensating for the resistance of the intermediate layer.

Figures 3A, 3B:
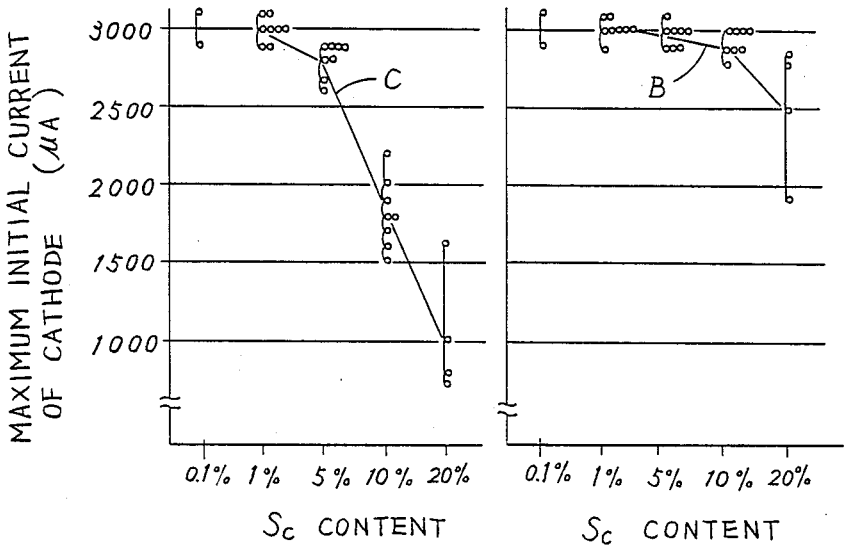
FIGS. 3A and 3B reveal an effect of the heat treatment for the scandium oxide powder in the present invention.

Comparing FIGS. 3A and 3B, there will be seen a preferable effect of the above described heat treatment for the scandium oxide powder. In each of the figures, the vertical axis indicates the maximum initial cathode current, while the horizontal axis indicates the scandium oxide content. The scandium oxide powder was not subjected to the heat treatment in FIG. 3A, though it was subjected to in FIG. 3B. As seen from a plotted curve C in FIG. 3A, the maximum initial cathode current decreases steeply as the non-treated scandium oxide content increases, and also scattering of the current values with the same scandium oxide content is large. As seen from a plotted curve B in FIG. 3B, on the other hand, the initial cathode current decreases much more gently as the treated scandium oxide content increases, and further scattering of the current values with the same scandium oxide content is not so large. Namely, the heat treatment for the scandium oxide powder ensures the stable current characteristics of the cathode regardless of the scandium oxide content.

Figure 4:
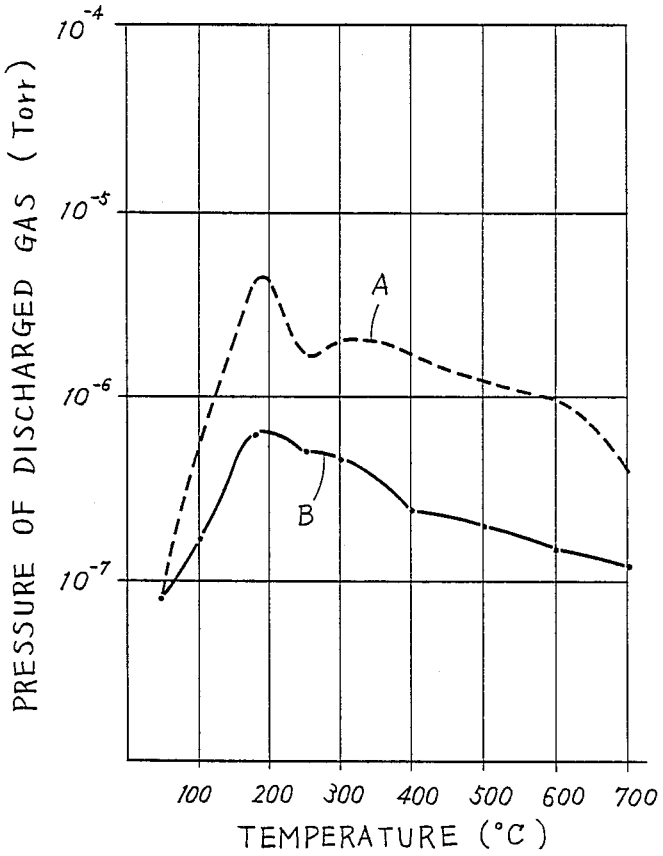
FIG. 4 shows gas discharge from the heat-treated and non-treated scandium powders.

Referring to FIG. 4, the reason for the above described effect of the heat treatment will be understood. The vertical axis indicates the pressure of gas discharged from the scandium oxide powder, while the horizontal axis indicates the temperature. A solid line B and a broken line C represent the gas discharge characteristics of the heat-treated and non-treated scandium oxide powders, respectively. Since the non-treated scandium oxide powder discharges more gas containing oxygen, the oxygen gas discharged during the above described aging process again oxidizes and decreases the free Ba. Namely, the less gas discharge of the heat-treated scandium oxide powder ensures the stable current characteristics of the cathode.

Figure 5:
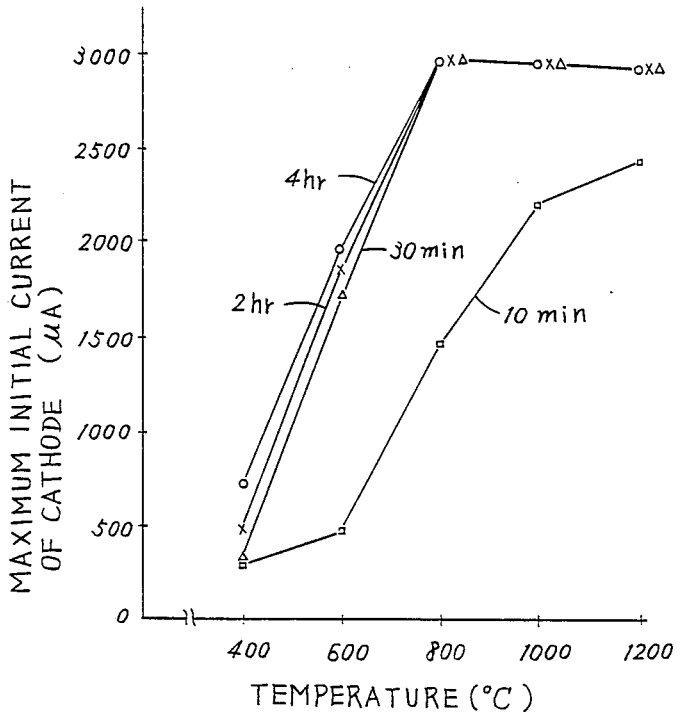
FIG. 5 shows the influence of the temperature and time of the heat treatment.

Referring to FIG. 5, there is shown the influence of the temperature and time of the heat treatment on the maximum initial current of the cathode. The vertical axis indicates the cathode current, while the horizontal axis indicates the temperature. As seen in FIG. 5, the heat treatment at a temperature more than 800° C. for a period more than 30 min shows the preferable effect on the cathode current. However, the period more than 2 hours does not produce any additional or better effect Meanwhile, the temperature higher than 1100° C. tends to make the scandium oxide powder sintered, and the scandium oxide powder thus heat-treated is not so well dispersed in the suspension. Consequently, the heat treatment at 800°–1100° C. for 0.5–2 hours in an oxidizing atmosphere containing oxygen gas may be preferable.

The cathodes with the scandium oxide contents of 0.1, 1.0, 5.0, 10 and 20 wt. % have been described, because the scandium oxide content of less than 0.1 wt. % shows little effect in the accelerated life test and the same of more than 20 wt. % largely deteriorates the maximum initial current characteristics of the cathode.

Although the scandium oxide powder was added and mixed in the suspension which had been prepared in advance and contained the alkaline earth metal carbonate in the above embodiments, the scandium oxide powder may be simultaneously mixed with the alkaline earth metal carbonate, the binder and the organic solvent by a ball mill.

The present invention is applicable to cathodes for a cathode-ray tube, a pickup tube, a transmitting tube, a discharge tube, etc.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An oxide-coated cathode for an electron tube, comprising:

a base comprising nickel as a major element, said base having an outer surface;

a reducing agent contained in said base;

only at least a portion of said outer surface of said base having coated thereon, as substantially the sole electron emissive substance, a layer of a substance comprising an alkaline earth metal oxide and scandium, and a heater for heating said layer.

2. The cathode in accordance with claim 1, wherein said layer contains the scandium oxide in an amount of about 0.1–20 wt. %.

3. The cathode in accordance with claim 1, wherein said reducing agent contains at least one of silicon and magnesium.

4. The cathode in accordance with claim 1, wherein said alkaline earth metal oxide comprises oxides of barium, strontium and calcium.

5. The cathode in accordance with claim 2, wherein said scandium oxide had been subjected to a heat treatment prior to mixing in said layer.

6. The cathode according to claim 1, wherein said layer contains $Sc_2O_3$ in addition to said scandium.

7. The cathode according to claim 1, wherein said scandium is effective to extend an operating life of said cathode at an enhanced current density.

8. The cathode according to claim 1, wherein said scandium is effective to minimize degradation of emission of said cathode at an enhanced current density.

9. The cathode according to claim 1, wherein said layer is coated on said surface of said base to a thickness of about 60–100 microns.

10. An oxide-coated thermionic cathode, comprising:

a base containing nickel as a major element with a reducing agent; and a layer of an electron-emissive substance coated on the exterior of said base, said electron-emissive layer being formed by forming a suspension containing scandium oxide powder and alkaline earth metal carbonate powder, and applying to said base.

11. The cathode as defined in claim 10, wherein said scandium oxide powder is heat-treated scandium oxide powder.

12. In an oxide-coated thermionic cathode, wherein a layer of an electron -emissive substance comprising an oxide of an alkaline earth metal including Ba is coated on the surface of a base comprising Ni and at least one reducing agent, free Ba being produced by reduction of said alkaline earth metal oxide by said at least one reducing agent, and wherein an interface layer containing an oxide of said at least one reducing agent is formed between said base and said electron-emissive layer as a result of partial reduction of said alkaline earth metal oxide layer so as to reduce an electron emission characteristic of said cathode by limiting production of free Ba in said cathode:

the improvement for enhancing said electron-emission characteristic of said cathode, comprising mixing scandium oxide with said alkaline earth metal oxide in formation of said coated layer.

13. The improvement of claim 12, wherein the electron-emission characteristic which is enhanced is cathode current density.

14. The improvement of claim 12, wherein the electron-emission characteristic which is enhanced is cathode life.

* * * * *